US011006697B2

(12) United States Patent
Cooper

(10) Patent No.: US 11,006,697 B2
(45) Date of Patent: May 18, 2021

(54) TENSILE STRAND

(71) Applicant: NIKE, Inc., Beaverton, OR (US)

(72) Inventor: Aaron A C Cooper, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 17 days.

(21) Appl. No.: 16/244,022

(22) Filed: Jan. 9, 2019

(65) Prior Publication Data

US 2019/0246742 A1 Aug. 15, 2019

Related U.S. Application Data

(60) Provisional application No. 62/628,754, filed on Feb. 9, 2018.

(51) Int. Cl.

| | |
|---|---|
| ***A43B 23/02*** | (2006.01) |
| ***A43C 5/00*** | (2006.01) |
| ***A43B 5/00*** | (2006.01) |
| ***A43B 5/10*** | (2006.01) |
| ***A43B 5/06*** | (2006.01) |

(52) U.S. Cl.

CPC ..... *A43B 23/0275* (2013.01); *A43B 5/00* (2013.01); *A43B 5/06* (2013.01); *A43B 5/10* (2013.01); *A43C 5/00* (2013.01)

(58) Field of Classification Search

CPC .... A43C 1/04; A43C 1/00; A43C 9/00; A43C 11/00; A43C 11/002; A43C 11/008

USPC ..... 36/51; 24/68 SK

See application file for complete search history.

(56) References Cited

U.S. PATENT DOCUMENTS

| | | | | |
|---|---|---|---|---|
| 4,553,342 | A | 11/1985 | Derderian et al. | |
| 6,029,376 | A | 2/2000 | Cass | |
| 6,513,210 | B1 | 2/2003 | Gonzalez | |
| 8,490,299 | B2 | 7/2013 | Dua et al. | |
| 8,800,172 | B2 | 8/2014 | Dua et al. | |
| 8,819,963 | B2 | 9/2014 | Dojan et al. | |
| 8,973,410 | B1 * | 3/2015 | Podhajny | A43B 23/04 66/177 |
| D734,017 | S * | 7/2015 | Avar | D2/972 |
| 9,072,335 | B1 | 7/2015 | Podhajny | |

(Continued)

FOREIGN PATENT DOCUMENTS

| | | | |
|---|---|---|---|
| CN | 202233365 | U | 5/2012 |
| CN | 104981176 | A | 10/2015 |

(Continued)

OTHER PUBLICATIONS

Solereview, "Nike Air Zoom Odyssey 2 Review," retrieved from: https://www.solereview.com/nike-air-zoom-odyssey-2-review/, dated Nov. 30, 2016, 19 pages.

*Primary Examiner* — Jameson D Collier

*Assistant Examiner* — Patrick J. Lynch

(74) *Attorney, Agent, or Firm* — Klarquist Sparkman, LLP

(57) ABSTRACT

An article of footwear includes a sole structure, an upper, and a tensile strand. The upper is coupled to the sole structure and has a medial portion, a lateral portion, an interior surface, and an exterior surface. The tensile strand has a first portion, a second portion, and a third portion disposed between the first and second portions. The first and second portions are disposed adjacent the interior surface of the upper and have a first cross-sectional profile that is flat. The third portion extends from the exterior surface of the upper and has a second cross-sectional profile that is rounded.

20 Claims, 6 Drawing Sheets

(56) References Cited

U.S. PATENT DOCUMENTS

| | | | | |
|---|---|---|---|---|
| 9,107,478 | B2 | 8/2015 | Dekovic et al. | |
| 9,113,674 | B2 | 8/2015 | Dojan | |
| 9,420,850 | B2 | 8/2016 | Dojan et al. | |
| 9,474,331 | B2 | 10/2016 | Waatti | |
| 9,545,128 | B2 | 1/2017 | Podhajny et al. | |
| 9,681,706 | B2 | 6/2017 | Dojan et al. | |
| 10,660,408 | B2 * | 5/2020 | Houng | A43C 1/06 |
| 2005/0217089 | A1 * | 10/2005 | Lin | A43C 9/00 24/712 |
| 2007/0294868 | A1 | 12/2007 | Gnatenko | |
| 2010/0154256 | A1 * | 6/2010 | Dua | A43B 1/04 36/25 R |
| 2013/0019500 | A1 * | 1/2013 | Greene | A43B 23/025 36/50.1 |
| 2013/0145652 | A1 * | 6/2013 | Podhajny | A43B 23/0255 36/50.1 |
| 2014/0245633 | A1 | 9/2014 | Podhajny | |
| 2016/0120264 | A1 | 5/2016 | Bardini et al. | |
| 2016/0331083 | A1 | 11/2016 | Uesato | |
| 2016/0331084 | A1 * | 11/2016 | Xanthos | A43C 11/008 |
| 2017/0020231 | A1 | 1/2017 | Hausmann et al. | |
| 2017/0202296 | A1 * | 7/2017 | Fuerst, Jr. | A43B 23/027 |

FOREIGN PATENT DOCUMENTS

| | | | | |
|---|---|---|---|---|
| FR | 3019009 | A1 | 5/2016 | |
| GB | 665958 | A | 2/1952 | |
| WO | WO-2009148901 | A1 * | 12/2009 | A43C 5/00 |
| WO | WO 2014/124071 | A1 | 8/2014 | |

* cited by examiner

TENSILE STRAND

CROSS-REFERENCE TO RELATED APPLICATION

This application claims the benefit of U.S. Provisional Application No. 62/628,754, filed Feb. 9, 2018, which is incorporated by reference herein.

FIELD

This disclosure relates generally to closure systems and/or support members for articles of footwear.

BACKGROUND

Articles of footwear, such as shoes, typically include a closure system that can be opened or loosened to allow a wearer to insert a foot into the article. The closure system can then be closed or tightened to secure the article to the wearer's feet. Some closure systems include laces, straps, strands, and/or cords that are used to adjust the closure system and/or to provide additional support or reinforcement to the article.

DETAILED DESCRIPTION

General Considerations

Figure 1:
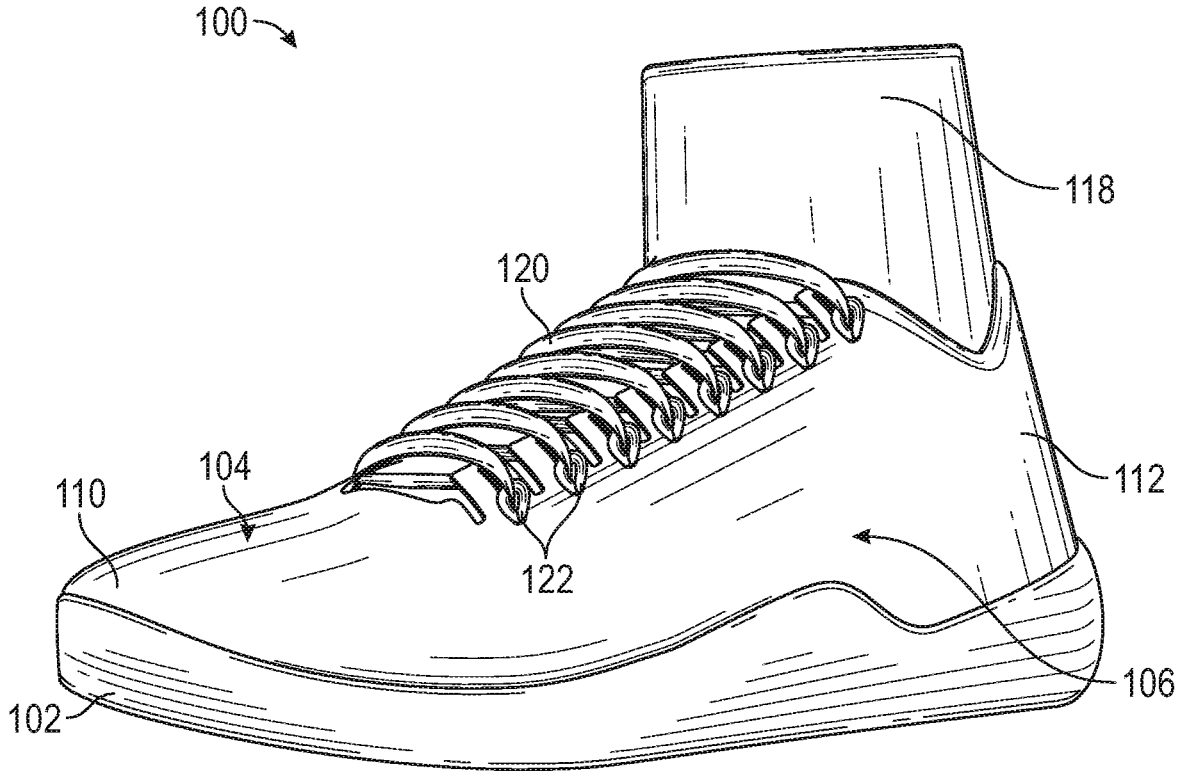
FIG. 1 is a perspective view of an exemplary embodiment of an article of footwear.

For purposes of this description, certain aspects, advantages, and novel features of the embodiments of this disclosure are described herein. The present disclosure is directed toward all novel and nonobvious features and aspects of the various disclosed embodiments, alone and in various combinations and sub-combinations with one another. Features, dimensions, characteristics, or groups described in conjunction with a particular aspect, embodiment or example are to be understood to be applicable to any other aspect, embodiment or example described herein unless incompatible therewith. The disclosed methods, systems, and apparatus are not limited to any specific aspect, feature, or combination thereof, nor do the disclosed methods, systems, and apparatus require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods, systems, and apparatus can be used in conjunction with other systems, methods, and apparatus.

The explanations of terms and abbreviations herein are provided to better describe the present disclosure and to guide those of ordinary skill in the art in the practice of the present disclosure. As used herein, "comprising" means "including" and the singular forms "a" or "an" or "the" include plural references unless the context clearly dictates otherwise. The term "or" refers to a single element of stated alternative elements or a combination of two or more elements, unless the context clearly indicates otherwise.

As used herein, the term "and/or" used between the last two of a list of elements means any one or more of the listed elements. For example, the phrase "A, B, and/or C" means "A," "B," "C," "A and B," "A and C," "B and C," or "A, B, and C."

As used herein, the term "coupled" generally means physically coupled or linked and does not exclude the presence of intermediate elements between the coupled items absent specific contrary language.

As used herein, the terms "articles of footwear" or "articles" mean any type of footwear, including, for example, running shoes, soccer shoes, football shoes, rugby shoes, basketball shoes, baseball shoes, sneakers, hiking boots, sandals, socks, etc.

As used herein "rectangular" means that a first dimension (e.g., a width) is greater than a second dimension (e.g., a thickness) of an object. "Rectangular" includes configurations that are substantially rectangular, e.g., vertexes are rounded so as to have certain radiuses of curvature or sides are loosely curved, and the configuration on the whole is rectangular.

As used herein "circular" means having the form of a circle and includes configurations that are substantially circular (e.g., ovular).

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the following description and the claims.

Introduction to the Disclosed Technology

Closure systems for articles of footwear ("articles") can include laces or other adjustment structures for adjusting the closure system and/or providing additional support or reinforcement to the articles. Some closure systems include more than one adjustment structure. For example, a closure system can have a lace that is interwoven between a medial side portion and a lateral side portion of the article. In addition to the lace, the closure system can include tensile strands. The tensile strands can extend from a sole structure of the article and be coupled to the lace. The tensile strands can be configured to provide additional adjustability to the closure system and/or support to the wearer's foot.

Described below are various embodiments of tensile strands that can, for example, improve the comfort of the article and/or improve the adjustability of the closure system.

Exemplary Embodiments

In one representative embodiment, an article of footwear comprises a sole structure, an upper, and a tensile strand. The upper is coupled to the sole structure and has a medial portion, a lateral portion, an interior surface, and an exterior surface. The tensile strand has a first portion, a second portion, and a third portion disposed between the first and second portions. The first and second portions are disposed adjacent the interior surface of the upper and have a first cross-sectional profile that is flat. The third portion extends from the exterior surface of the upper and has a second cross-sectional profile that is rounded.

In some embodiments, the first and second portions of the tensile strand have a width that is greater than a thickness of the third portion of the tensile strand when the tensile strand is in a relaxed configuration.

In some embodiments, the third portion of the tensile strand defines an eyelet.

In some embodiments, the cross-sectional profiles of the first and second portions of the tensile strand are rectangular, and the cross-sectional profile of the third portion of the tensile strand is circular.

In some embodiments, the first, second, and third portions of the tensile strand are integrally formed as a single, continuous piece of material.

In some embodiments, the upper comprises an opening from which the third portion of the tensile strand extends.

In some embodiments, the article of footwear further comprises a lace member that extends between the medial and lateral portions of the upper and engages the tensile strand.

In another representative embodiment, an article of footwear comprises a sole structure, an upper, a first lace member, and a plurality of second lace members. The upper has a medial portion, a lateral portion, an interior surface, and an exterior surface. The first lace member extends between the medial and lateral portions. The second lace members each have a first portion, a second portion, a third portion disposed between the first and second portions, and a longitudinal axis extending though the first, second, and third portions. The first and second portions extend adjacent the interior surface of the upper and have flat cross-sectional profiles taken in planes perpendicular to the longitudinal axis. The third portion extends from the exterior surface and has a rounded cross-sectional profile taken in a plane perpendicular to the longitudinal axis.

In some embodiments, the upper comprises a plurality of openings, and the third portion of each of the second lace member extends from a respective opening in the upper.

In some embodiments, the first and second portions of each second lace member have fixed ends that are secured to the sole structure and spaced relative to each other.

In some embodiments, the fixed end of the first portion of each second lace member is spaced toward a toe portion of the article of footwear relative to the fixed end of the respective second portion.

In another representative embodiment, an article of footwear comprises a sole structure, an upper, and a plurality of tensile strands. The upper is coupled to the sole structure and has a medial portion, a lateral portion, an interior surface, and an exterior surface. The tensile strands each have a first portion, a second portion, and a third portion disposed between the first and second portions. The first and second portions are disposed adjacent the interior surface of the upper and have flat cross-sectional profiles. The third portion extends from the outer surface of the upper and has a rounded cross-sectional profile.

In some embodiments, the first and second portions of the tensile strands have fixed ends, and the fixed ends of each of the first portions are spaced toward a toe portion of the article of footwear relative to the respective fixed ends of the second portions.

In some embodiments, the article of footwear further comprises a lace member that extends between the medial and lateral portions of the upper and engages the tensile strands.

In some embodiments, the plurality of tensile strands includes a first tensile strand disposed on the medial portion of the upper and a second tensile strand disposed on the lateral portion of the upper.

In some embodiments, the plurality of tensile strands includes a first plurality of tensile strands disposed on the medial portion of the upper and a second plurality of tensile strands disposed on the lateral portion of the upper.

In another representative embodiment, an article of footwear comprises a sole structure, an upper, and a tensile strand. The upper is coupled to the sole structure and has a medial portion, a lateral portion, an interior surface, and an exterior surface. The tensile strand has a plurality of first portions, a plurality second portions. The first portions are disposed adjacent the interior surface of the upper and have flat cross-sectional profiles. The second portions are disposed between adjacent first portions, extend from the exterior surface of the upper, and have rounded cross-sectional profiles.

In some embodiments, the upper further comprises a lower edge and an upper edge, wherein the first portions of the tensile strand extend from the lower edge of the upper toward the upper edge of the upper.

In some embodiments, at least some of the first portions are coupled to the sole structure or the upper.

In some embodiments, the upper includes a slotted eyelet having a major axis and a minor axis, and a width of the slotted eyelet along the major axis is larger than thickness of the slotted eyelet along the minor axis.

FIGS. 1-8 show an exemplary embodiment of an article of footwear 100 (which is also referred to herein as "the article 100") and its components. Referring to FIG. 1, the article 100 can include two main components: a sole structure 102 and an upper 104 coupled to the sole structure 102.

In the certain embodiments, the article 100 can take the form of an athletic shoe, such as a tennis shoe, a running shoe, or a basketball shoe. It should be noted, however, that the article can take various other forms, including hiking boots, skateboarding shoes, sandals, and other types of footwear.

In some embodiments, the sole structure 102 and the upper 104 can be formed as a single, integral structure. In other embodiments, the upper 104 can be coupled to the sole structure 102, as shown, for example, in the illustrated embodiment.

Generally, the upper 104 can be any type of upper. For example, in embodiments where the article 100 is a tennis shoe or a running shoe, the upper 104 can be a low-top upper. In embodiments where the article 100 is a basketball shoe, the upper 104 can be a high-top upper that is shaped to provide high support on a wearer's ankle.

Figure 2:
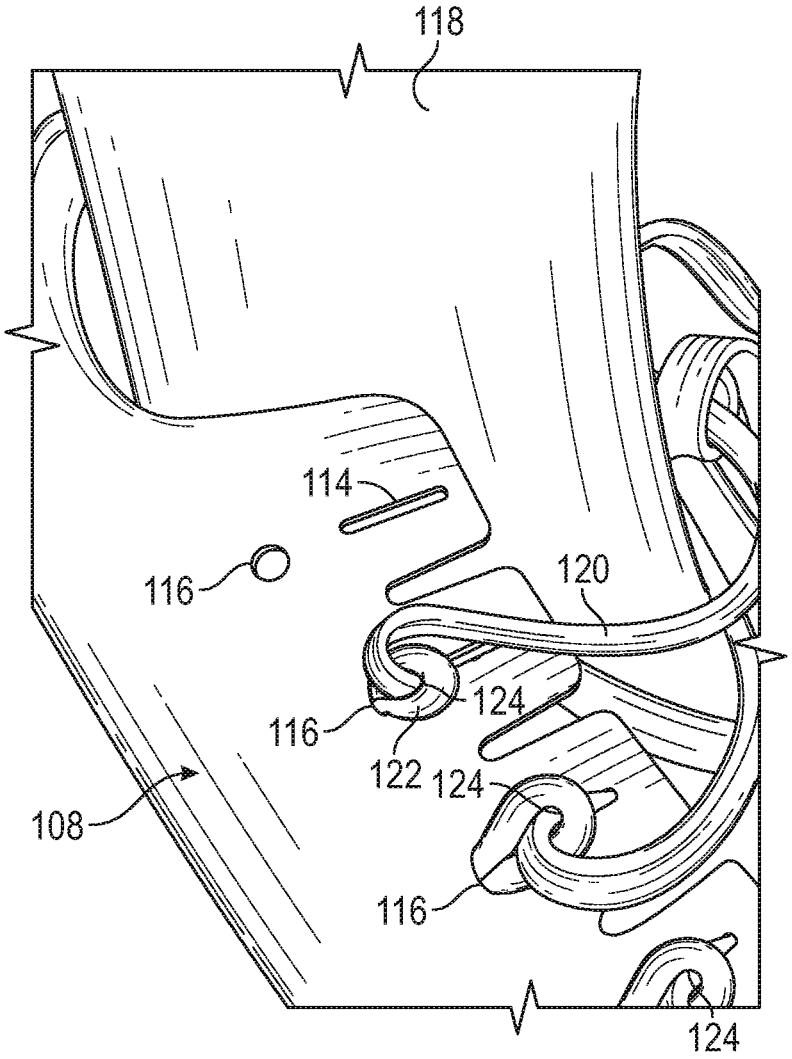
FIG. 2 is a detail view of a closure system of the article of footwear, showing the closure system partially unlaced.

The upper 104 can have a lateral side portion 106, a medial side portion 108 (FIG. 2), a toe portion 110, and a heel portion 112. Referring to FIG. 2, the upper 104 can also include one or more eyelets 114 and one or more openings 116 formed in the lateral and medial side portions 106, 108. The eyelets 114 and the openings 116 on the lateral side portion 106 can be spaced apart from the eyelets 114 and the openings 116 on the medial side portion 108. An optional sock liner 118 (and/or a tongue) can, in some embodiments, be disposed between the lateral side portion 106 and the medial side portion 108.

The article 100 can further comprise a lace (or primary lace) 120 and one or more tensile strands (or secondary laces) 122. The lace 120 and the tensile strands 122 together with eyelets 114 and openings 116 of the upper 104 can form a closure system of the article 100. The closure system can be opened or loosened such that the wearer can insert their foot into the article 100. The closure system can also be closed or tightened to secure the article 100 to the wearer's foot.

Figure 5:
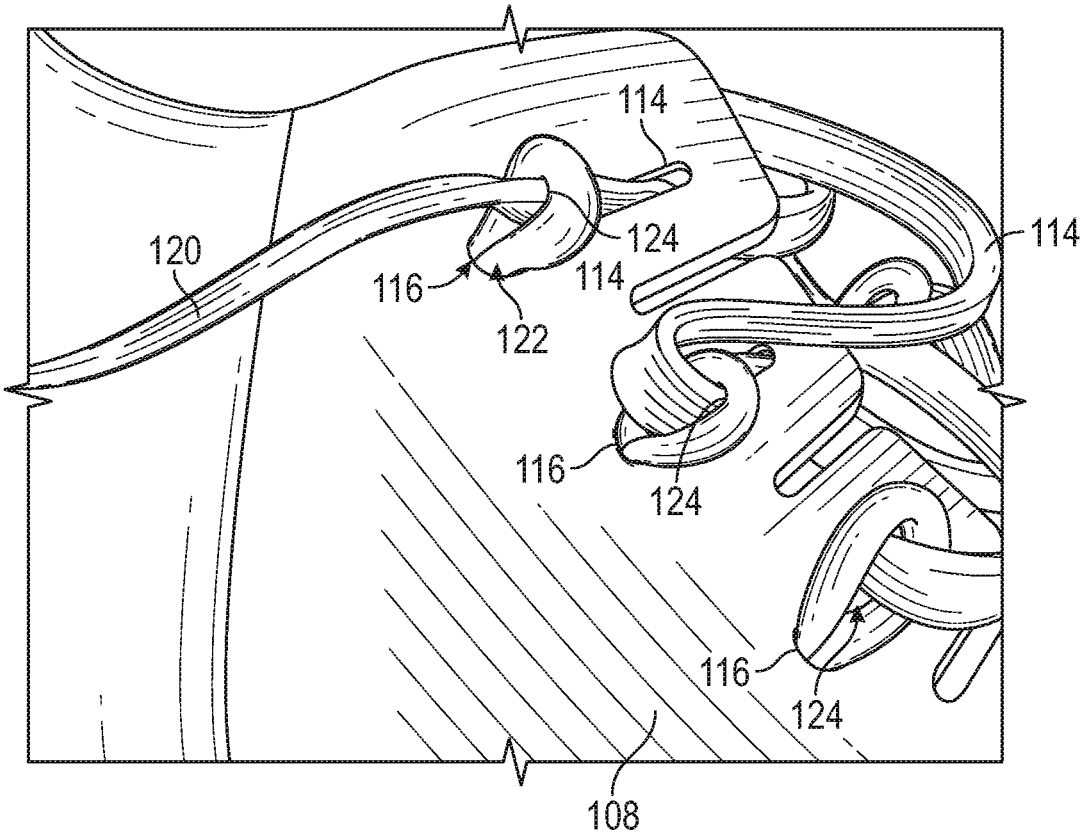
FIG. 5 is a detail view of a closure system of the article of footwear, showing the closure system fully laced and in a loosened configuration.

Referring now to FIGS. 2 and 5, the eyelets 114 can be configured for receiving the lace 120. The openings 116 can be configured for receiving the tensile strands 122. The tensile strands 122 can also define apertures or loops 124 through which the lace 120 can also extend.

The lace 120 can articulate relative to the eyelets 114 and/or the openings 116 to help accommodate various tensions of the lace 120 and/or the tensile strands 122. The configuration of the eyelets 114 and/or openings 116 can thereby provide improved adjustability, which can help accommodate various shapes and/or sizes of feet. This can be accomplished in several ways. For example, referring to FIGS. 6 and 7B, the eyelets 114 can define an elongate slot that has a width $W_S$ (FIG. 6) that is wider than a width $W_L$ (FIG. 7B) of the lace 120. As such, the lace 120 can move relative to the eyelet 114 as the lace 120 wraps around the tensile strands 122 at different angles depending on the tightness of the lace 120 and the tensile strands 122, the shape and size of the wearer's foot, and/or other factors.

Figure 8:
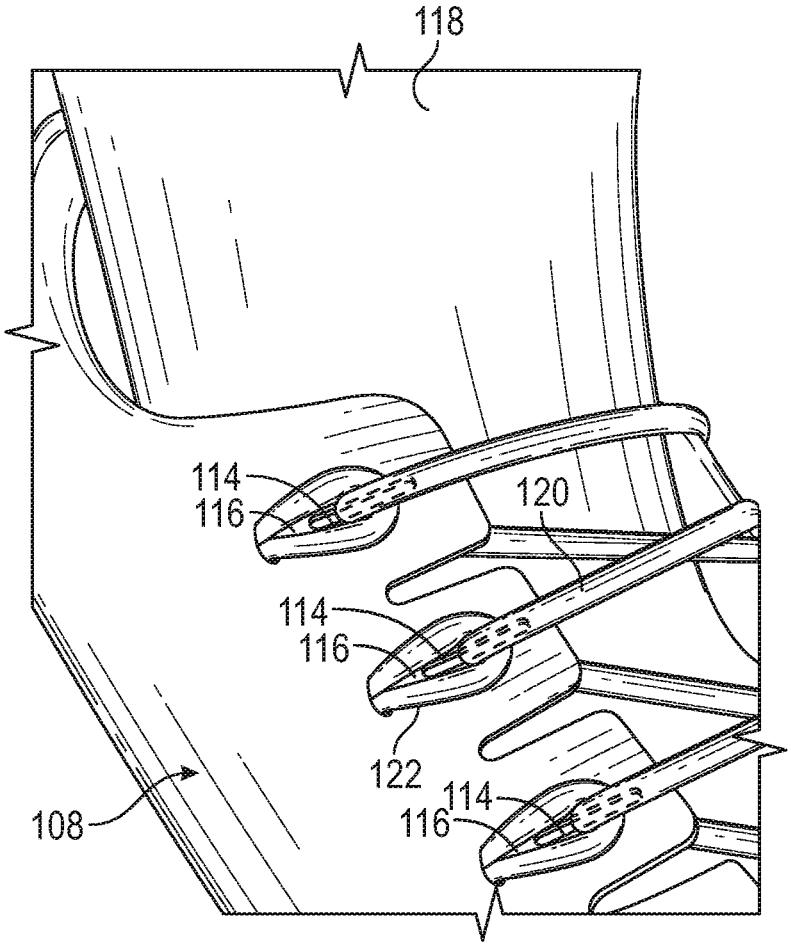
FIG. 8 is a detail view of a closure system of the article of footwear, showing the closure system fully laced and in a tightened configuration.

For example, referring to the uppermost eyelet 114 shown in FIG. 5, the eyelet 114 can be sized and/or configured such that the lace is spaced from the lateral (innermost) edge of the opening 116 (i.e., the right edge of the opening 116 in the orientation shown in FIG. 5) when the shoe is in a loosened configuration, a partially tightened configuration, and/or possibly a tightened configuration depending on the shape and/or size of the wearer's foot. One reason for this is that the tensile strand 122 can hold the lace 120 toward the medial (outermost) edge of the opening 116 (i.e., the left edge of the opening 116 in the orientation shown in FIG. 5). As the lace 120 and thus the tensile strand 122 is tightened, the lace 120 can move from a position at or near the medial (outermost) edge of the opening toward a position at or near the lateral (innermost) edge of the opening 116, as shown in FIG. 8.

Figure 6:
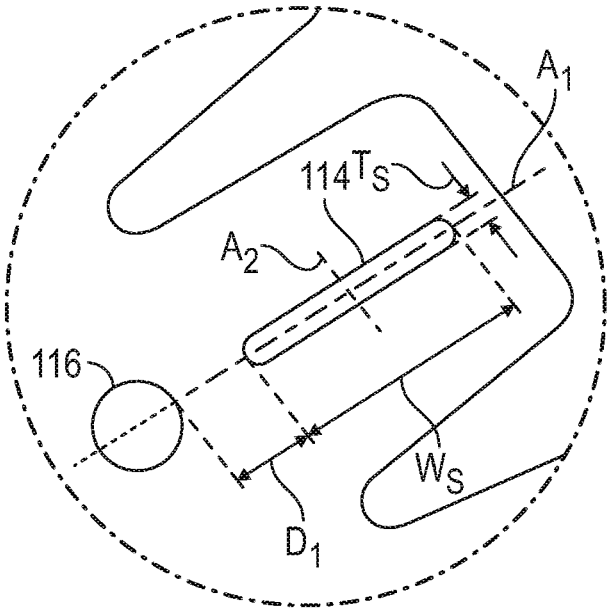
FIG. 6 is a detail view of a slotted eyelet and opening of the article of footwear.
Figure 7A:
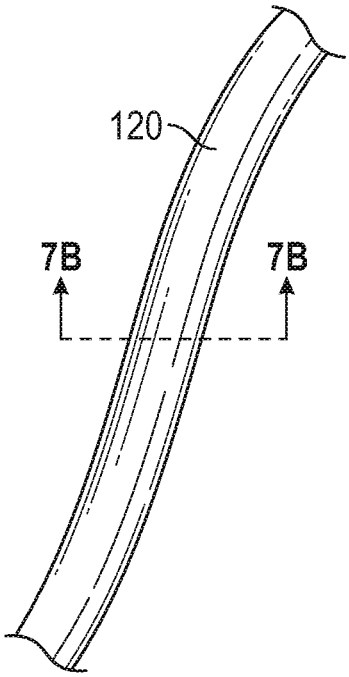
FIG. 7A is a perspective view of a lace of the article of footwear.
Figure 7B:
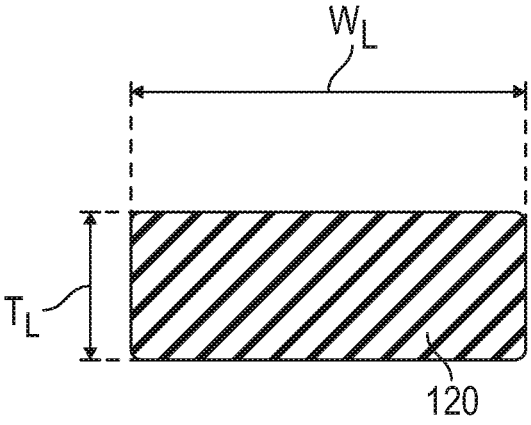
FIG. 7B is a cross-sectional view of the lace of the article of footwear.

As shown in FIG. 6, the slotted eyelet 114 can have a major axis $A_1$ and a minor axis $A_2$ that is perpendicular to the major axis $A_1$. The width $W_S$ of the slotted eyelet 114 can be measured along the major axis $A_1$. A thicknesses $T_S$ of the slotted eyelet 114 can be measured along the minor axis $A_2$. As shown in FIG. 7B, the lace 120 can have a thickness $T_L$ and a width $W_L$, as measured in a relaxed condition (i.e., without any external forces applied to the lace 120) or in a tensed condition. The thickness $T_S$ of the slotted eyelet 114 can be the same or substantially the same as a thickness $T_L$ of the lace 120. Accordingly, for rectangular laces (i.e., $W_L > T_L$), the lace 120 can slide relative to the slotted eyelet 114 along the major axis $A_1$ but generally will not twist or otherwise adjust its position relative to the minor axis $A_2$.

In certain embodiments, a ratio of the width $W_S$ of the slotted eyelet 114 to the width $W_L$ of the lace 120 can be 1.1-4.0 or, in some embodiments, 1.5-3.5.

In some embodiments, a ratio of the thickness $T_S$ of the slotted eyelet 114 to the thickness $T_L$ of the lace 120 can be 0.9-1.1 or, in some embodiments, 0.95-1.05.

The openings 116 can comprise various shapes such as circular, rectangular, ovular, triangular, star-shaped, etc. The openings 116 can be aligned with the major axis $A_1$ of the slotted eyelet 114. For example, a center-point or midpoint of the opening 116 can be aligned with the major axis $A_1$ of the slotted eyelet 114.

The openings 116 can be spaced from the slotted eyelet by a distance $D_1$. In particular embodiments, the distance $D_1$ can be 0.1-3.0 inches or 0.25-2.0 inches. In some embodiments, $D_1$ can be greater than or equal to a length of the exposed portion of the tensile strand 122 when the tensile strand is in a relaxed condition.

In some embodiments, the slotted eyelets 114 can be used with articles that do not have tensile strands 122. For example, the slotted eyelets 114 can be used with an article that has loop or secondary eyelets that are formed in or coupled to the upper 104.

In lieu of or in addition to the slotted eyelets 114, a first portion of the upper 104 that is adjacent to the eyelets 114 can be formed from relatively flexible or elastic material, and a second portion of the upper 104 that is adjacent to the openings 116 can be formed from relatively stiff or inelastic material. As such, the eyelets 114 can translate relative to their respective openings 116 as the flexible material of the upper stretches when the lace 120 is tightened. In such embodiments the distance D1 can increase by 10-25% or 0.1-0.5 inches from when the lace 120 is slackened to when the lace is tightened.

Figure 3:
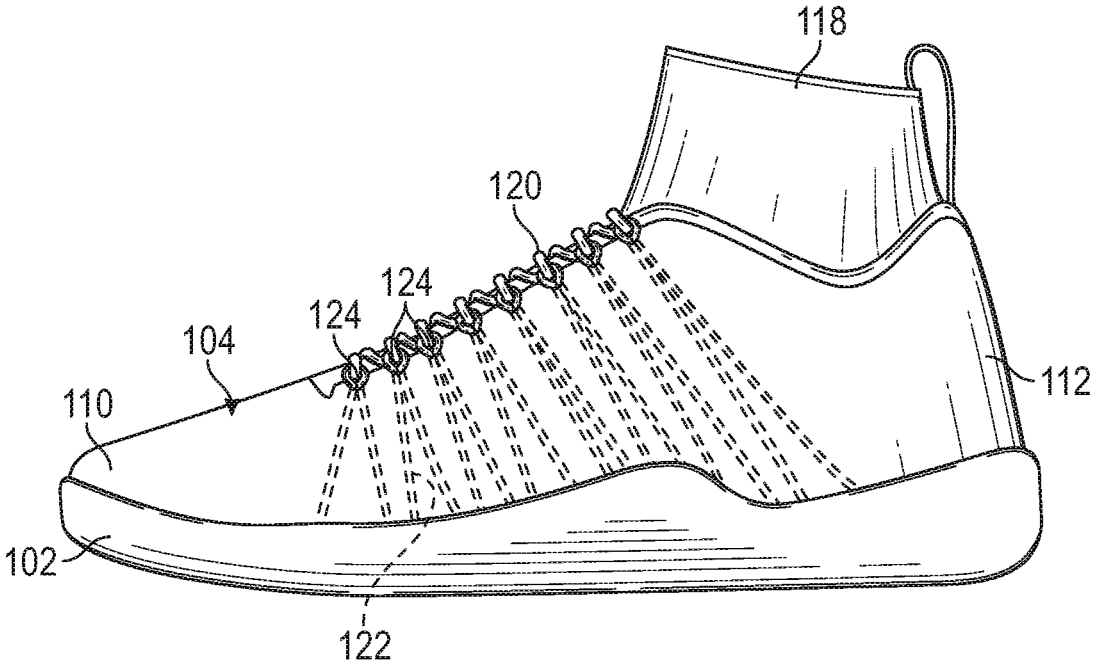
FIG. 3 is a side elevation view of the article of footwear, showing tensile strands in broken lines.
Figure 4:
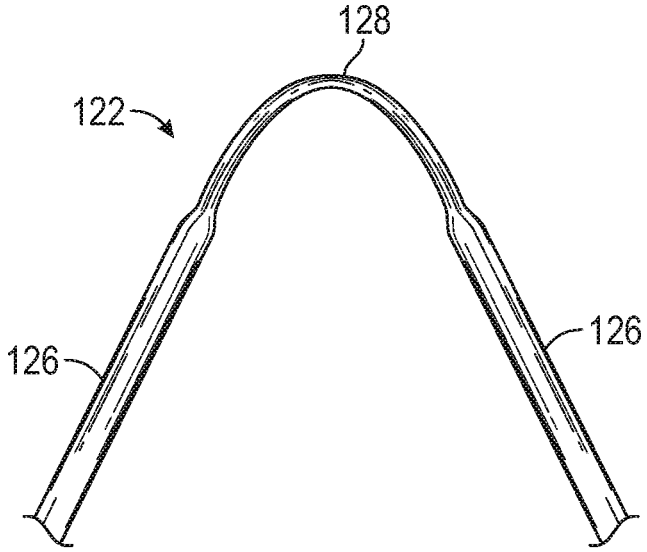
FIG. 4 is a detail view of a tensile strand of the article of footwear.

Referring to FIG. 3, the tensile strands 122 can be coupled to the sole structure 102 and/or a lower edge portion of the upper 104. The tensile strands 122 can extend upwardly from the sole structure 102 toward an upper edge portion of the upper (i.e., toward the openings 116). In some embodiments, the tensile strands 122 can extend along or adjacent to an interior surface of the upper 104 such that only a portion of the tensile strands 122 are exposed (e.g., the loops 124).

The tensile strands 122 can, for example, be formed of a relatively less stretchable material that the upper 104. As such, the tensile strands 122 can provide additional support to the wearer's feet. This additional support can, for example, be advantageous during activities (e.g., tennis, basketball, etc.) with frequent acceleration, deceleration, and/or direction changes.

In some embodiments, the tensile strands 122 can be V-shaped. The "legs" of the "V" can be coupled to the sole structure 102, and the "point" of the "V" can extend through the opening 116 of the upper 104. In certain embodiments, the legs of adjacent tensile strands can overlap.

In some embodiments, a separate tensile strand 122 can extend through each opening 116 of the upper 104 with an exposed portion forming the loops 124. In other words, an upper having sixteen openings (i.e., eight openings on the lateral side and eight openings on the medial side) can have 16 tensile strands, each extending from the sole structure 102 and through a respective opening 116 of the upper 104.

In another embodiment, loops or eyelets (e.g., similar to loops 124) can be coupled to the tensile strands (e.g., at ends of the tensile strands). In other embodiments, the loops or eyelets can be connected to the upper.

In other embodiments, one or more of the tensile strands 122 can extend through a plurality of openings 116 in the upper 104. For example, a first tensile strand can extend through each of the openings 116 on the lateral side portion 106 of the upper 104, and a second tensile strand can extend through each of the openings 116 on the medial side portion 108 of the upper 104. In such embodiments, each tensile strand 122 can extend from the sole structure 102, through a first opening in the upper 104, back to the sole structure, through a second opening in the upper, back to the sole structure, and so on. Stated another way, one tensile strand can zigzag between the sole structure 102 and the openings 116 that are disposed on the lateral side portion 106 of the upper 104, and another tensile strand can zigzag between the sole structure 102 and the openings 116 that are disposed on the medial side portion 108 of the upper 104. The tensile strands 122 can be secured to the sole structure 102 and/or the upper 104 at each end (i.e., toward the toe and heel portions) and/or at various intermediate locations.

As mentioned above, a portion of the tensile strands 122 can form the loops 124 that extend from the openings 116 and through which the lace 120 extends.

In particular embodiments, the tensile strands 122 can also have a plurality of portions or sections. One or more of those portions can have a different cross-sectional profile or shape than one or more other portions. For example, referring to FIG. 4, the tensile strands 122 can have two flat portions 126 (e.g., with a rectangular cross-sectional profile) and one rounded portion 128 (e.g., with a circular or annular cross-sectional profile) disposed between the flat portions 126. Providing tensile strands with different cross-sectional profiles along their length can, for example, improve the comfort the article on the wearer's foot and and/or improve the functionality of the closure system.

The flat portions 126 can be coupled to the sole structure 102 and can be sized and/or configured to extend along the interior (i.e., non-exposed) surface of the upper 104. In this manner, the flat portions 126 are disposed between the wearer's foot and the interior surface of the upper 104 when the wearer's foot is inserted into the article 100. The profile of the flat portions 126 of the tensile strands 122 can be relatively wide compared to the thickness. For example, the flat portions 126 of the tensile strands 122 can be ⅜-¾ inches wide and 1/32-1/16 inches thick. This flat profile can, for example, distribute load or pressure from the tensile strand 122 on the wearer's foot and upper over a wide area (and without adding undesirable bumps or bulges to the upper. Configuring the tensile strands 122 in this manner can, for example, improve the wearer's comfort and/or increase support to the wearer's foot.

The tensile strands 122 can be sized and/or configured such that the round portions 128 extend through the openings 116 and extend outwardly from an exterior surface of the upper 104. The circular or annular cross-sectional profile can, for example, allow the round portions 128 of the tensile strands 122 to more easily fit through and/or move relative to the openings 116 than a cross-sectional profile with edges or corners (e.g., rectangular, triangular, etc.). The round portions 128 of the tensile strands 122, which can include the loops 124, can also facilitate movement of the lace member 120 through the loops 124, thus improving the adjustability of the closure system of the article 100.

Accordingly, the tensile strands 122 that have a plurality of a plurality of portions with different cross-sectional profiles (e.g., flat-round-flat) can, for example, improve the comfort of the article and/or improve the functionality of the closure system.

A tensile strand having a plurality of cross-sectional profiles can be formed in various ways. For example, in some embodiments, the flat portions 126 and the round portions 128 can be formed as separate pieces that are coupled together with adhesive, fasteners, stitching, and/or other means for coupling. In other embodiments, the flat and round portions 126, 128 can be integrally formed as a single, continuous piece of material.

Additional information regarding tensile strands can be found, for example, in U.S. Pat. Nos. 9,113,674 and 9,681,706, which are incorporated by reference herein.

The technologies from any example can be combined with the technologies described in any one or more of the other examples. For example, one or more of the technologies described with respect to an article having the slotted eyelets 114 can be combined with one or more of the technologies described with respect to an article having the flat-round-flat tensile strands 122, or vice versa. As another example, the various technologies of any example can be separated from one or more of the other technologies of the example. For example, an article may have the slotted eyelets 114 and not the flat-round-flat tensile strands 122, or vice versa.

It should be noted that, although the exemplary embodiments are directed to articles of footwear, the disclosed technology can be adapted to various other items with laced closures systems (e.g., gloves, etc.).

In view of the many possible embodiments to which the principles of the disclosure may be applied, it should be recognized that the illustrated embodiments are only preferred examples and should not be taken as limiting the scope of the claims. Rather, the scope of the claimed subject matter is defined by the following claims and their equivalents.

The invention claimed is:

1. An article of footwear, comprising:

a sole structure;

an upper coupled to the sole structure and having a medial portion, a lateral portion, an interior surface, and an exterior surface; and a tensile strand having a first portion, a second portion, and a third portion disposed between the first and second portions, wherein the first and second portions are disposed inwardly from the interior surface of the upper such that the first and second portions are positioned between a wearer's foot and the interior surface of the upper when the wearer's foot is inserted into the article of footwear, wherein the first and second portions have a first cross-sectional profile that is flat along a first length of the tensile strand, wherein the third portion extends from the exterior surface of the upper and has a second cross-sectional profile that is rounded along a second length of the tensile strand, wherein the first length of the tensile strand is greater than the second length of the tensile strand, wherein the first and second portions of the tensile strand have a width that is greater than a thickness of the third portion of the tensile strand when the tensile strand is in a relaxed configuration or a tensed configuration.

2. The article of footwear of claim 1, wherein the third portion of the tensile strand defines an eyelet.

3. The article of footwear of claim 1, wherein the first cross-section profile of the tensile strand is rectangular, and wherein the second cross-sectional profile of the tensile strand is circular.

4. The article of footwear of claim 1, wherein the first, second, and third portions of the tensile strand are integrally formed as a single, continuous piece of material.

5. The article of footwear of claim 1, wherein the upper comprises an opening from which the third portion of the tensile strand extends.

6. The article of footwear of claim 1, further comprising a lace member that extends between the medial and lateral portions of the upper and engages the tensile strand.

7. An article of footwear, comprising:

a sole structure;

an upper coupled to the sole structure and having a medial portion, a lateral portion, an interior surface, and an exterior surface;

a first lace member extending between the medial and lateral portions; and a plurality of second lace members, each having:

a first portion, a second portion, a third portion disposed between the first and second portions, and a longitudinal axis extending through the first, second, and third portions, wherein the first and second portions are positioned inward relative to the interior surface of the upper and collectively form a first length of the second lace member, wherein the first length has a first, flat cross-sectional profile defined by a first plane perpendicular to the longitudinal axis, wherein the third portion extends from the exterior surface and forms a second length of the second lace member, wherein the second length has a second, rounded cross-sectional profile defined by a second plane perpendicular to the longitudinal axis, wherein the first cross-sectional profile is different than the second cross-sectional profile, wherein the first plane is spaced from the second plane along the longitudinal axis, and wherein the second length of the second lace member is less than the first length of the second lace member.

8. The article of footwear of claim 7, wherein the upper comprises a plurality of openings, and the third portion of each of the second lace members extends from a respective opening in the upper.

9. The article of footwear of claim 7, wherein each of the first and second portions of each second lace member has fixed ends that are secured to the sole structure and spaced relative to each other.

10. The article of footwear of claim 9, wherein the fixed end of the first portion of each second lace member is spaced toward a toe portion of the article of footwear relative to the fixed end of the respective second portion.

11. An article of footwear, comprising: a sole structure; an upper coupled to the sole structure and having a medial portion, a lateral portion, an interior surface, and an exterior surface; and a plurality of tensile strands, each having:

a first portion, a second portion, and a third portion disposed between the first and second portions, wherein the first and second portions taken together define a first length of the tensile strand, are disposed inwardly from the interior surface of the upper, and have first, flat cross-sectional profiles, wherein the third portion defines a second length of the tensile strand, extends from the exterior surface of the upper, forms an eyelet, and has a second, rounded cross-sectional profile, wherein the first cross-sectional profiles are different than the second cross-sectional profile, and wherein the first length of the tensile strand is greater than the second length of the tensile strand.

12. The article of footwear of claim 11, wherein each of the first and second portions of the tensile strands has fixed ends, and the fixed ends of each of the first portions are spaced toward a toe portion of the article of footwear relative to the respective fixed ends of the second portions.

13. The article of footwear of claim 11, further comprising a lace member that extends between the medial and lateral portions of the upper and engages each eyelet of the tensile strands.

14. The article of footwear of claim 11, wherein the plurality of tensile strands includes a first tensile strand disposed on the medial portion of the upper and a second tensile strand disposed on the lateral portion of the upper.

15. The article of footwear of claim 11, wherein the plurality of tensile strands includes a first plurality of tensile strands disposed on the medial portion of the upper and a second plurality of tensile strands disposed on the lateral portion of the upper.

16. The article of footwear of claim 11, wherein the first cross-section profile of each tensile strand is rectangular, and wherein the second cross-sectional profile of each tensile strand is circular.

17. The article of footwear of claim 11, wherein the first, second, and third portions of each tensile strand are integrally formed as a single, continuous piece of material.

18. The article of footwear of claim 11, wherein the upper comprises an opening from which the third portion of each tensile strand extends.

19. The article of footwear of claim 11, further comprising a lace member that extends between the medial and lateral portions of the upper and engages each tensile strand.

20. The article of footwear of claim 11, wherein the first and second portions of each tensile strand have fixed ends that are secured to the sole structure and spaced relative to each other.

* * * * *